US010591266B2

(12) United States Patent
Berseneff et al.

(10) Patent No.: US 10,591,266 B2
(45) Date of Patent: Mar. 17, 2020

(54) DISTRESS FLARE

(71) Applicant: COMMISSARIAT A L'ENERGIE ATOMIQUE ET AUX ENERGIES ALTERNATIVES, Paris (FR)

(72) Inventors: Boris Berseneff, La Tronche (FR); Daniel Chatroux, Teche (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 16/222,233

(22) Filed: Dec. 17, 2018

(65) Prior Publication Data

US 2019/0186882 A1 Jun. 20, 2019

(30) Foreign Application Priority Data

Dec. 19, 2017 (FR) ..... 17 62406

(51) Int. Cl.

| | |
|---|---|
| ***F42B 12/42*** | (2006.01) |
| ***F42B 12/36*** | (2006.01) |
| ***G08B 5/00*** | (2006.01) |
| ***F42B 4/28*** | (2006.01) |
| ***F42B 4/26*** | (2006.01) |

(52) U.S. Cl.

CPC ..... *F42B 12/42* (2013.01); *F42B 4/26* (2013.01); *F42B 4/28* (2013.01); *F42B 12/365* (2013.01); *G08B 5/002* (2013.01)

(58) Field of Classification Search

CPC .... F42B 4/24; F42B 4/28; F42B 12/42; F42B 12/365; G08B 5/002

See application file for complete search history.

(56) References Cited

U.S. PATENT DOCUMENTS 4,622,557 A * 11/1986 Westerfield ..... G01S 5/0009 342/357.48
5,386,781 A * 2/1995 Day ..... F42B 4/28 102/337
5,427,032 A * 6/1995 Hiltz ..... F42B 4/26 102/336

(Continued)

FOREIGN PATENT DOCUMENTS

FR 2 862 279 5/2005
KR 10-2013-0038676 4/2013

(Continued)

OTHER PUBLICATIONS

U.S. Appl. No. 15/108,193, filed Jun. 24, 2016, 2016/0329549 A1 Nov. 10, 2016, Daniel Chatroux et al.

(Continued)

*Primary Examiner* — Joshua T Semick
(74) *Attorney, Agent, or Firm* — Oblon, McClelland, Maier & Neustadt, L.L.P.

(57) ABSTRACT

A distress flare including a cartridge including two ends connected by a side surface; activation device intended to expel the cartridge into the sky; an inflatable shell, covering the side surface, suitable for being deployed under the effect of deploying device and of diffusing the visible light; illuminating device powered by a battery and capable of emitting visible light, the illuminating device being arranged on the side surface.

19 Claims, 1 Drawing Sheet

(56) References Cited

U.S. PATENT DOCUMENTS

| | | | | |
|---|---|---|---|---|
| 5,530,445 | A * | 6/1996 | Veazey | B63C 9/00 114/102.3 |
| 6,082,675 | A * | 7/2000 | Woodall, Jr. | B64D 1/02 244/137.4 |
| 6,260,508 | B1 * | 7/2001 | Morse | B63C 9/0005 116/211 |
| 6,498,767 | B2 * | 12/2002 | Carreiro | B63B 22/003 244/137.4 |
| 6,807,127 | B2 * | 10/2004 | McGeever, Jr. | B63C 11/26 367/128 |
| 2012/0087385 | A1 * | 4/2012 | Oakes | F41J 2/02 372/34 |
| 2015/0062954 | A1 | 3/2015 | Crossland et al. | |
| 2015/0329771 | A1 | 11/2015 | Danielec et al. | |
| 2017/0276464 | A1 * | 9/2017 | Cayer | F42B 12/42 |
| 2019/0138005 | A1 * | 5/2019 | Wigell | G05D 1/0088 |
| 2019/0195604 | A1 * | 6/2019 | Rodgers, Jr. | F42B 12/40 |

FOREIGN PATENT DOCUMENTS

| | | |
|---|---|---|
| KR | 10-1664896 | 10/2016 |
| KR | 10-2017-0013726 | 2/2017 |

OTHER PUBLICATIONS

French Preliminary Search Report dated Aug. 24, 2018 in French Application 17 62406, filed on Dec. 19, 2017 (with English Translation of Categories of Cited Documents).

* cited by examiner

DISTRESS FLARE

TECHNICAL FIELD

This invention relates to a distress flare. In particular, this invention relates to a distress flare provided with illuminating means, in particular light emitting diodes, powered by a battery. According to a particularly advantageous feature, the distress flare is provided with an inflatable shell which, when deployed, diffuses the visible light emitted by the illuminating means in an isotropic manner.

PRIOR ART

A distress flare known in the prior art comprises a pyrotechnic charge which, when being consumed, emits very intense visible light intended to signal an emergency and/or dangerous situation.

The distress flare is generally propelled to an altitude of several hundred meters such that the visible light can be spotted over a long distance, for example several kilometers.

However, this distress flare known in the prior art is not satisfactory.

More specifically, the duration of the visible light emitted by the distress flare, which is dependent on the pyrotechnic charge, is relatively short and only allows for a short period of time for it to be spotted by an emergency rescue service for example.

The carriage of a larger pyrotechnic charge in order to increase the emission duration generates an undesired risk, in particular in an emergency situation.

Thus, one purpose of this invention is to propose a distress flare having arrangements allowing the emission duration of the visible light to be extended compared to known distress flares of the prior art.

Another purpose of this invention is to propose a distress flare for which the emission of the visible light can be managed in time, in particular after said flare falls to the ground or falls in water.

Another purpose of this invention is to propose a distress flare that is capable of modulating the intensity of the visible light emitted.

DESCRIPTION OF THE INVENTION

This invention relates to a distress flare provided with a cartridge and activation means intended to propel said cartridge into the sky.

According to one embodiment of this invention, the activation means comprise a case provided with a pyrotechnic charge, referred to as an expelling charge, intended to expel the cartridge.

The cartridge further comprises illuminating means capable of emitting visible light, in particular light emitting diodes, arranged on a side surface that connects the two ends of the cartridge.

The illuminating means are, as understood in this invention, powered by a battery.

In a particularly advantageous manner, the distress flare comprises an inflatable shell, covering the side surface, suitable for being deployed under the effect of deploying means and of diffusing the visible light.

The implementation of the inflatable shell allows the visible light emitted by the illuminating means to be diffused in an essentially isotropic manner.

Thus, the purposes of this invention are, at least partially, achieved by a distress flare that comprises:

- a cartridge comprising two ends connected by a side surface;
- activation means intended to propel the cartridge into the sky;
- illuminating means powered by a battery and capable of emitting visible light, said illuminating means being arranged on the side surface;
- an inflatable shell, covering the side surface, suitable for being deployed under the effect of deploying means and of diffusing the visible light.

According to one embodiment, the illuminating means comprise light emitting diodes intended to emit visible light according to a predetermined spectrum of wavelengths.

The light emitting diodes allow an optimized management of the energy they consume, and thus allow the emission duration of the visible light to be extended compared to known distress flares of the prior art.

Moreover, the light emitting diodes consume little energy, and thus do not require the carriage of a large quantity of energy.

According to one embodiment, the inflatable shell is coated in a layer of luminophore material intended to modify the spectral range of the visible light emitted by the illuminating means; advantageously the modification of the spectral range comprises a broadening of said range.

The combination of luminophores and light emitting diodes extends the width of the spectrum of the light effectively emitted by said diodes.

The implementation of the luminophores also boosts the isotropic diffusion of the light.

According to one embodiment, when deployed, the inflatable shell allows the distress flare to float.

Thus, the distress flare can advantageously be implemented over a body of water, for example offshore.

According to one embodiment, the deploying means comprise a pyrotechnic charge, referred to as a deploying charge, arranged at one end of the cartridge.

According to one embodiment, the activating means comprise a case, engaging with the cartridge, and provided with a pyrotechnic charge, referred to as an expelling charge, intended to propel the cartridge.

According to one embodiment, the distress flare comprises an electronic control module, powered by the battery, intended to modulate the intensity of the visible light as a function of the altitude of said flare according to predetermined criteria.

The control module is used to optimally manage the power of the battery and in particular the consumption of said power by the illuminating means.

According to one embodiment, the predetermined criteria requires that the illuminating means emit continuous visible light, the intensity whereof is at least equal to a first threshold intensity when the distress flare is located at an altitude that exceeds a threshold altitude.

According to one embodiment, the predetermined criteria requires that the illuminating means have an energy-saving mode when the distress flare is located at ground level and/or when the battery charge status is less than a threshold charge level, the energy-saving mode comprising the emission of intermittent visible light and/or of visible light having an intensity that is less than a second threshold intensity, whereby the second threshold intensity is less than the first threshold intensity.

According to one embodiment, the control module further controls the activation of the deploying means; advantageously, the control module is suitable for imposing the activation thereof when the distress flare has reached a maximum altitude.

According to one embodiment, the distress flare further comprises a distress module suitable for emitting a distress signal; advantageously, the distress signal is emitted on one of the international distress frequencies.

According to one embodiment, the flare further comprises a positioning module, advantageously a satellite positioning module, suitable for determining the position of the distress flare, said position being intended to be encoded in the distress signal emitted by the distress module.

According to one embodiment, the distress flare further comprises a parachute intended to be deployed during a so-called parachutal phase, and after having reached a maximum altitude, and advantageously intended to be ejected when said flare is located on the ground or in water.

According to one embodiment, the deployment of the parachute is controlled by the control module.

BRIEF DESCRIPTION OF THE FIGURES

Other characteristics and advantages shall be better understood after reading the following description of a distress flare according to the invention, provided as non-limiting examples only, with reference to the accompanying figures in which.

DETAILED DESCRIPTION OF THE SPECIFIC EMBODIMENTS

This invention relates to a distress flare provided with a cartridge and activation means intended to propel said cartridge into the sky.

According to one embodiment of this invention, the activation means comprise a case provided with a pyrotechnic charge, referred to as an expelling charge, intended to propel the cartridge.

The cartridge further comprises illuminating means capable of emitting visible light, in particular light emitting diodes, arranged on a side surface that connects the two ends of the cartridge.

The illuminating means are, as understood in this invention, powered by a battery.

In a particularly advantageous manner, the distress flare comprises an inflatable shell, covering the side surface, suitable for being deployed under the effect of deploying means and of diffusing the visible light.

The implementation of the inflatable shell thus allows the visible light emitted by the illuminating means to be diffused in an essentially isotropic manner.

Figure 1:
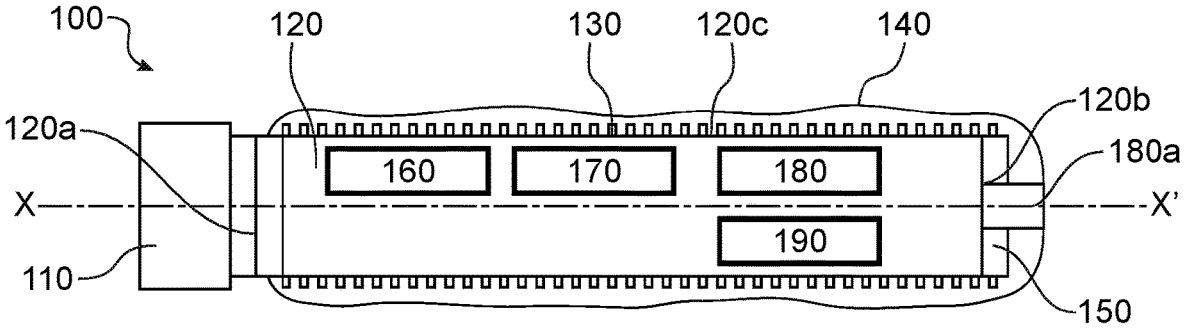
FIG. 1 is a diagrammatic view, according to a sectional plane comprising the XX' axis, of a distress flare before expulsion according to this invention.
Figure 2:
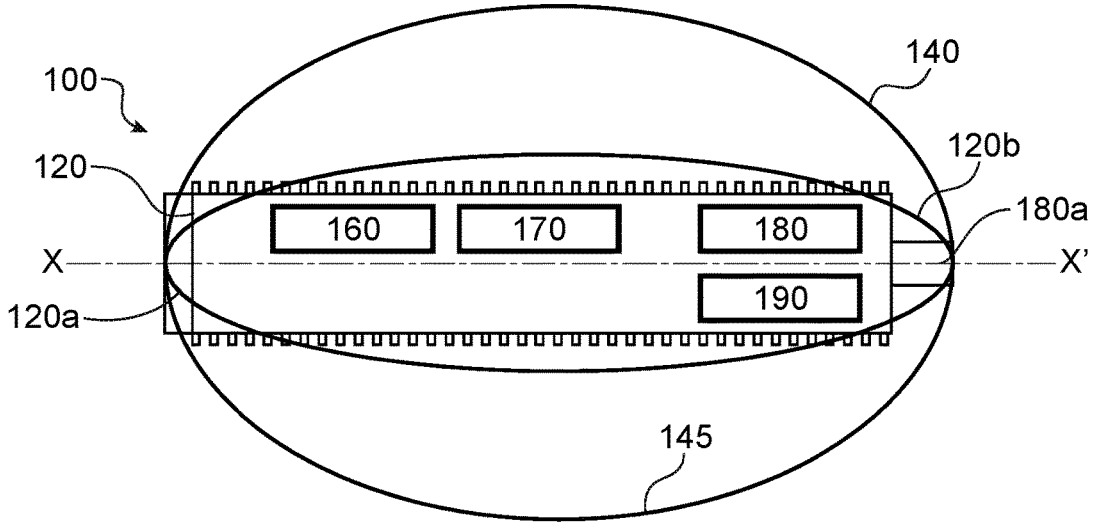
FIG. 2 is a diagrammatic view, according to a sectional plane comprising the XX' axis, of a distress flare separated from the activation means according to this invention.

FIGS. 1 and 2 respectively show a view of a distress flare 100 with the activation means 110 thereof, and of the distress flare separated from said activation means 110.

The activation means 110 can comprise a case, engaging with the cartridge, and provided with a pyrotechnic charge, referred to as an expelling charge, intended to propel the cartridge 120.

The expelling charge can comprise, for example, ammonium nitrate and/or propellant.

When expelled from the activation means and located at altitude, the distress flare 100 (more specifically the cartridge) is in the so-called ballistic phase.

The cartridge 120 extends between two ends 120*a* and 120*b* in alignment with an elongation axis XX'.

The cartridge 120 comprises, for example in the volume thereof, a battery 160.

The battery 160 comprises, for example, a lithium-ion battery which can have a cylindrical shape.

The two ends are connected by a side surface 120*c*.

The cartridge 120 can have an overall cylindrical shape. However, the invention is not necessarily limited to this shape.

Illuminating means 130, powered by the battery 160, are arranged on the side surface 120*c*.

The illuminating means 130 can comprise light emitting diodes intended to emit visible light according to a predetermined spectrum of wavelengths. The term "spectrum of wavelengths" shall be understood herein as both a single wavelength and as an extended range of wavelengths.

When the light emitting diodes are energy-saving, they allow the emission duration of the visible light to be prolonged compared to known distress flares of the prior art.

Moreover, the illumination by light emitting diodes limits the pyrotechnic charge carried on-board, and thus reduces the risk associated with such carriage since only the propulsion charge and the inflation charge remain (there is no longer any pyrotechnic illuminating charge).

The light emitting diodes can be diodes that emit white light, or diodes emitting substantially monochromatic light.

The distress flare 100 can further comprise an inflatable shell 140. In particular, the inflatable shell 140 covers the side surface 120*c* provided that the distress flare has not been activated.

The inflatable shell 140 is also suitable for being deployed under the effect of deploying means 150, and of diffusing the visible light emitted by the illuminating means 130.

The term "diffusing the visible light" shall be understood herein as making uni-directional light omnidirectional.

It is understood that when the shell 140 is intended to diffuse the visible light emitted by the illuminating means, the latter are positioned in an inner space delimited by the shell 140.

The deploying means 150 can, for example, comprise a pyrotechnic charge, referred to as a deploying charge, arranged, for example, at one end of the cartridge.

The deploying charge can, for example, comprise an ammonium nitrate pellet and/or propellant.

The inflatable shell 140 can comprise a fabric, in particular a plastic fabric, for example polyethylene or polyester.

In this respect, a person skilled in the art could view the document [1] cited at the end of the description.

The inflatable shell 140 can also be suitable, when deployed, for ensuring the floatation of the distress flare 100.

In other words, the inflatable shell 140 is mounted in a water-tight manner, for example at the ends 120*a* and 120*b* of the cartridge 120.

The inflatable shell 140 can be coated in a layer of luminophore material intended to modify the spectral range of the visible light emitted by the illuminating means.

Advantageously, the modification of the spectral range comprises an increase in said range. For example, when substantially monochromatic light emitting diodes are considered, the luminophore material can be suitable for transforming said substantially monochromatic light into light having a wide spectral range. More particularly, the light emitting diodes can, for example, emit blue light (at about 488 nm), and the luminophore material can convert said blue light into polychromatic light, the spectral range whereof includes the range of wavelengths 400 nm-700 nm.

The choice of luminophore material is within the capabilities of a person skilled in the art. In this respect, said person could view the document [2] cited at the end of the description, and in particular paragraphs 13 to 24, which provide a list of potentially suitable materials.

In a particularly advantageous manner, the distress flare 100 comprises an electronic control module 170 powered by the battery 160.

The control module 170 can comprise a printed circuit board provided with a program and/or instructions intended to be communicated to the different elements that it controls.

The production of such a control module falls within the general knowledge of a person skilled in the art, and is therefore not described herein.

The control module 170 is in particular intended to modulate the intensity of the visible light as a function of the altitude of said flare according to predetermined criteria. In other words, the control module 170 is used to adjust the intensity of the visible light emitted by the illuminating means 130.

For example, the control module 170 can force the illuminating means 130 to emit a light intensity that is greater than a first threshold intensity during the ballistic phase. For example, the control module 170 can force the illuminating means 130 to emit at their maximum intensity level during the ballistic phase.

During this ballistic phase, the visible light can be continuous, or can translate a message, for example in Morse code.

The control module 170 can also force the illuminating means 130 to implement an energy-saving mode.

For example, when the distress flare 100 is at ground level and/or when the battery charge status is less than a threshold charge level, the energy-saving mode can comprise the emission of intermittent visible light and/or visible light having an intensity that is less than a second threshold intensity, whereby the second threshold intensity is less than the first threshold intensity.

The emission of an intermittent light signal can comprise, for example, the emission of a flash of light every 10 seconds. The lapse of time between two flashes of light can increase in time in order to preserve the battery charge.

Additionally, the control module can further control the activation of the deploying means 150.

In particular, the control module 170 can be suitable for imposing the activation thereof when the distress flare has reached a maximum altitude during the ballistic phase.

In a particularly advantageous manner, the distress flare 100 can further comprise a distress module 180 suitable for emitting a distress signal; advantageously the distress signal is emitted on one of the international distress frequencies.

The international distress frequencies correspond to bands 406.028 MHZ and 121.5 MHZ.

The distress module 180 can also emit on other emergency frequencies such as, for example, on channel 16 VHF or even on the AIS frequency system (real-time ship tracking system).

The distress module 180 can comprise an emitting antenna 180*a* arranged at either of the ends 120*a* and 120*b* of the cartridge 120.

Finally, the distress module 180 can be suitable for receiving radio signals, in particular radio signals indicating the detection thereof. Under the stated conditions, when such signals have been received by the distress module, the control module 160 can adjust the light intensity emitted by the illuminating means (in particular increase said intensity and/or emit light continuously).

It is understood that the distress module 180 is powered by the battery 160 and controlled by the control module 170.

The flare can further comprise a positioning module 190 suitable for determining the position of the distress flare 100. Said position can advantageously be encoded in the distress signal emitted by the distress module 180.

The positioning module 190 is also powered by the battery 160 and controlled by the control module 170. The positioning module 190 can advantageously be a satellite positioning module, for example a GPS (Global Positioning System) module.

The distress flare 100 can further comprise a parachute intended to be deployed during a so-called parachutal phase, after having reached a maximum altitude during the ballistic phase.

The parachute thus allows the ballistic phase to be prolonged.

Advantageously, the parachute is also intended to be ejected when said flare is located on the ground or in water.

Also advantageously, the deployment and/or ejection of the parachute is/are controlled by the control module 170.

The distress flare 100 according to this invention has a light emission autonomy that exceeds that of known distress flares of the prior art. Indeed, the implementation of the inflatable shell and the capacity thereof to diffuse the light emitted by the illuminating means such as light emitting diodes allows the luminous flux of a known flare of the prior art to be reproduced.

Moreover, the implementation of the control module allows the power supplied by the battery to be managed. In particular, the control module is used to adjust the intensity of the light emitted by the illuminating means in order to prolong the duration of the light emission from the distress flare.

REFERENCES

[1] FR 2 862 279 A1;
[2] US 2015/0329771 A1.

The invention claimed is:

1. A distress flare comprising:

a cartridge comprising two ends connected by a side surface;

activation means configured for expelling the cartridge into the sky;

illuminating means powered by a battery and capable of emitting visible light, said illuminating means being arranged on the side surface; and deploying means for deploying an inflatable shell that covers the side surface, wherein the inflatable shell is configured to diffuse the visible light.

2. The distress flare according to claim 1, wherein the illuminating means includes light emitting diodes configured to emit visible light according to a predetermined spectrum of wavelengths.

3. The distress flare according to claim 2, wherein the inflatable shell is coated in a layer of luminophore material configured to modify the spectral range of the visible light emitted by the illuminating means.

4. The distress flare according to claim 3, wherein the modification of the spectral range comprises an increase in said range.

5. The distress flare according to claim 1, wherein the inflatable shell, when deployed, allows the distress flare to float.

6. The distress flare according to claim 1, wherein the deploying means includes a pyrotechnic charge arranged at one end of the cartridge.

7. The distress flare according to claim 1, wherein the activation means includes a case engaging with the cartridge, and includes a pyrotechnic charge configured to expel the cartridge.

8. The distress flare according to claim 1, wherein the distress flare includes an electronic control module, powered by the battery, configured to modulate an intensity of the visible light as a function of an altitude of said flare according to predetermined criteria.

9. The distress flare according to claim 8, wherein the predetermined criteria requires that the illuminating means emit continuous visible light, the intensity whereof is at least equal to a first threshold intensity when the distress flare is located at an altitude that exceeds a threshold altitude.

10. The distress flare according to claim 8, wherein the predetermined criteria requires that the illuminating means have an energy-saving mode when the distress flare is located at ground level and/or when the charge status of the battery is less than a threshold charge level, wherein the energy-saving mode includes the emission of intermittent visible light and/or of visible light having an intensity that is less than a second threshold intensity, whereby the second threshold intensity is less than the first threshold intensity.

11. The distress flare according to claim 8, wherein the control module further controls an activation of the deploying means.

12. The distress flare according to claim 11, wherein the control module is configured to initiate the activation when the distress flare has reached a maximum altitude.

13. The distress flare according to claim 8, wherein the distress flare further comprises a distress module suitable for emitting a distress signal.

14. The distress flare according to claim 13, wherein the flare further comprises a positioning module configured to determine a position of the distress flare, said position being encoded in the distress signal emitted by the distress module.

15. The distress flare according to claim 14, wherein the positioning module is a satellite positioning module.

16. The distress flare according to claim 13, wherein the distress signal is emitted on an international distress frequency.

17. The distress flare according to claim 1, wherein the distress flare further comprises a parachute configured to be deployed during a parachutal phase, and after having reached a maximum altitude.

18. The distress flare according to claim 17, wherein the distress flare comprises an electronic control module, powered by the battery, configured to modulate an intensity of the visible light as a function of an altitude of said flare according to predetermined criteria, and wherein the deployment of the parachute is controlled by the control module.

19. The distress flare according to claim 17, wherein the parachute is configured to be ejected when said flare is located on the ground or in water.

* * * * *